US009815483B2

(12) United States Patent
Koerner et al.

(10) Patent No.: US 9,815,483 B2
(45) Date of Patent: Nov. 14, 2017

(54) RIDE-UP PROTECTION MEANS

(71) Applicant: SIEMENS AKTIENGESELLSCHAFT, Munich (DE)

(72) Inventors: Marcus Koerner, Grossinzemoos (DE); Alexander Trachtenherz, Munich (DE)

(73) Assignee: Siemens Aktiengesellschaft, Munich (DE)

( * ) Notice: Subject to any disclaimer, the term of this patent is extended or adjusted under 35 U.S.C. 154(b) by 162 days.

(21) Appl. No.: 14/654,613

(22) PCT Filed: Dec. 3, 2013

(86) PCT No.: PCT/EP2013/075339

§ 371 (c)(1),
(2) Date: Jun. 22, 2015

(87) PCT Pub. No.: WO2014/095339

PCT Pub. Date: Jun. 26, 2014

(65) Prior Publication Data

US 2016/0023672 A1 Jan. 28, 2016

(30) Foreign Application Priority Data

Dec. 21, 2012 (DE) ..... 10 2012 224 193

(51) Int. Cl.
*B61G 11/16* (2006.01)
*B61D 15/06* (2006.01)
*B61G 11/18* (2006.01)

(52) U.S. Cl.
CPC ..... *B61G 11/16* (2013.01); *B61D 15/06* (2013.01); *B61G 11/18* (2013.01)

(58) Field of Classification Search
CPC ..... B61D 15/04; B61D 15/06; B61D 15/008; B61D 15/08; B61G 11/00; B61G 11/10;
(Continued)

(56) References Cited

U.S. PATENT DOCUMENTS

2010/0218701 A1 9/2010 Graf et al.

FOREIGN PATENT DOCUMENTS

DE 19833250 A1 1/2000
DE 20117536 U1 1/2002
(Continued)

*Primary Examiner* — R. J. McCarry, Jr.
(74) *Attorney, Agent, or Firm* — Laurence Greenberg; Werner Stemer; Ralph Locher

(57) ABSTRACT

A device for preventing rail vehicles from riding up includes an energy absorbing element extended in longitudinal direction, having a hollow inside, a fastening side for fastening to one of the rail vehicles and an impact side facing away from the fastening side. A flange fastened to the impact side of the energy absorbing element has an impingement surface facing away from the fastening side. The flange protrudes in at least one vertical direction beyond a contour delimited by the energy absorbing element on the impact side, forming a holding web protruding beyond the energy absorbing element. The device provides effective ride-up protection for identically and differently equipped rail vehicles by equipping a free end of the holding web with at least one vertical stop extending up from the impingement surface, and providing a device for moving the vertical stop upon an impact loading in longitudinal direction.

10 Claims, 4 Drawing Sheets

(58) Field of Classification Search
CPC ..... B61G 11/12; B61G 11/14; B61G 11/16; B61G 11/18
See application file for complete search history.

(56) References Cited

FOREIGN PATENT DOCUMENTS

| | | | | | |
|---|---|---|---|---|---|
| DE | 102007005421 | A1 | | 8/2008 | |
| EP | 2033868 | A1 | | 3/2009 | |
| EP | 2033868 | | * | 11/2009 | ..... B61D 15/06 |
| EP | 2163454 | A1 | | 3/2010 | |
| RU | 2010115496 | A | | 10/2011 | |

* cited by examiner

RIDE-UP PROTECTION MEANS

BACKGROUND OF THE INVENTION

Field of the Invention

Such a device is already known from DE 198 33 250 A1. A box-type energy absorbing element for accepting a central flange buffer is provided and extends from a fastening side, on which it is fastened to a rail vehicle, to an impact side. A flange is attached to the impact side. This can either be closed or can have a circular cutout. The cutout serves to insert a central flange buffer into the energy absorbing element, so that only a buffer plunger projects towards the collision side. No ride-up protection means is provided.

DE 201 17 536 U1 discloses a ride-up protection means for rail vehicles which are equipped with side buffers. The device disclosed therein has an energy absorbing element which is embodied hollow, wherein a reversibly displaceable buffer plunger extends centrally from the impact side into the energy absorbing element. Above and below the buffer plunger there are ribs embodied on the impact side of the energy absorbing element, which are designed to prevent the rail vehicle riding up. The described ride-up protection means however can only be effective when the height difference between the colliding buffers is small. Enlarging the overall construction would actually make it possible to avoid riding-up even with a large vertical offset of the impact partners. The enlargement would however lead to a significant stiffening of the energy absorbing element, which in such cases reaches a rigidity which would represent an unacceptable safety risk for the vehicle body.

Further devices for preventing rail vehicles riding up are known from DE 10 2007 005 421 A1, EP 2 033 868 A1 and EP 2 163 454 A1.

Rail vehicles generally have subframes with high rigidity. As a rule structural units with lower rigidity by comparison are provided on such subframes. With frontal impacts between two rail vehicles a vertical offset of the subframes as a result of the collision, in other words a riding-up of the rail vehicle, generally leads to severe damage. A riding-up of the rail vehicle should therefore be avoided where possible.

The general practice of arranging collision plates with horizontal ribs on the front side of rail vehicles is known. In a collision the ribs engage with one another so that riding up is prevented. However the precondition for this is that the impact plates can get close enough to one another for their ribs to engage with one another, so the vertical forces can be transferred.

The devices known from the prior art have the disadvantage that, in a collision of rail vehicles with buffers which have a smooth surface, no effective engagement with the ribs provided on the collision plates can take place. Ride-up protection is therefore not provided.

BRIEF SUMMARY OF THE INVENTION

The object of the invention is therefore to create a device of the type stated at the start which, both for rail vehicles equipped similarly and also for rail vehicles equipped differently, provides an effective ride-up protection.

The invention achieves this object by the holding web being equipped on its free end with at least one vertical stop projecting from the impingement surface, wherein means are provided for shifting the vertical stop during an impact stress in the longitudinal direction.

In accordance with the invention a ride-up protection means is provided having an irreversibly-deformable energy absorbing element, which on its impact side, on which the impact of the colliding rail vehicle is to be expected, is equipped with a flange. On its surface facing towards the colliding rail vehicle the flange has an impingement surface which projects beyond the outer contour of the energy absorbing element. The impingement surface provided for the event of a collision is enlarged within the context of the invention compared to the impingement surfaces of previously known devices. Because of the enlarged impingement surface, even colliding rail vehicles which have buffers or energy absorbing elements with a vertical offset come into contact on their impingement surfaces with the impingement surface of the inventive device. The impact energy is therefore effectively conveyed in accordance with the invention via the flange into the energy absorbing element. The vertical stop which is embodied as part of the invention on the holding web of the flange and indeed at said web's free end, prevents a riding-up of rail vehicles with a smooth impingement surface. The vertical stop therefore produces its effect within the framework of the invention even with a vertical offset, i.e. a height difference between the energy absorbing elements or buffers colliding with one another.

As part of the invention the vertical direction extends in each direction which makes a right angle with the said longitudinal direction. Preferably the vertical direction however extends downwards and/or upwards at right angles to the longitudinal direction, i.e. the direction of travel of the rail vehicle. The holding web is disposed within the context of the invention at its free end, for example above and/or below the energy absorbing element. It has at least one vertical stop.

In a collision between similar rail vehicles which are both equipped with an inventive device, there is a vertical offset or no vertical offset between the initially colliding energy absorbing elements. Within the context of the invention means are therefore provided for shifting the vertical stop, which shift the vertical stop during a collision from the impingement surface which could otherwise have a disruptive effect on the ride-up protection. In a collision between different rail vehicles the vertical stop prevents riding-up. Within the context of the invention an effective ride-up protection is therefore provided both for similar and also for different parties to the impact in the event of a collision.

Preferably the means for shifting the vertical stop comprises a holding web which is dimensioned so that said web is bent towards the fastening side during an impact stress in the longitudinal direction. Through this bending the vertical stop no longer projects forwards from the smooth impingement surface. Instead the holding web is bent far enough for the tip of the vertical stop with its free end to be approximately flush in the plane defined by the collision surface. A disruptive effect of the vertical stop is thus prevented.

In addition it is possible as part of the invention for the means for shifting the vertical stop to have fastening means for fastening the vertical stop to the holding web which, for an impact stress in the longitudinal direction, make a displacement of the vertical stop in the holding web towards the fastening side possible. In accordance with this advantageous further development, fastening means holds the vertical stop in or on the free end of the vertical limb in a manner which, in the event of a collision, makes it possible for the vertical stop to be moved in the holding web. In accordance with this advantageous development the holding web does not have to be bent. In other words the holding web of the flange, as a result of its dimensioning, i.e. for example as a result of its thickness and its short length, can have a rigidity by which it is prevented from bending in the event of a collision. The holding web can therefore—if said web is equipped with ribs—contribute to preventing the riding-up. The said fastening means, as part of the invention, can for example comprise a splint, pin, a screw, rivet fastening with an intentional break point. In addition it is possible as part of the invention for the fastening means to provide a clamping seat, wherein, if a limit force is exceeded, the displacement of the vertical stop in the holding web is made possible.

Advantageously the vertical stop is realized as a stop web extending at right angles to the impingement surface. The stop web extends out from the impingement surface forwards in a longitudinal direction, wherein it is preferably disposed above the energy absorbing element. In this case the vertical direction extends from bottom to top.

In the assembled state the longitudinal direction is the same as the direction of travel of the rail vehicle on which the inventive device is fastened.

In accordance with a preferred embodiment of the invention the impingement surface projects beyond the contour of the energy absorbing element on its impact side in two vertical directions facing away from one another. It is especially advantageous for the impingement surface to project beyond the energy absorbing element upwards and downwards in the assembled state.

The energy absorbing element is basically of any given design within the context of the invention. It is especially advantageous for the energy absorbing element to narrow from its fastening side towards the impact side. Here it is embodied in the shape of a box or as a type of obelisk for example.

Furthermore it is possible as part of the invention for the hollow energy absorbing element to have a guide tube which extends inside the energy absorbing element from its impact side out towards the fastening side. It is especially advantageous when the guide tube is essentially arranged centrally in the energy absorbing element.

Expediently the guide tube is configured to engage into a cutout provided in the rail vehicle. This said cutout is preferably embodied in a cross member of a subframe or a carriage body. In the event of a collision the energy absorbing element is folded together or compressed like a concertina. The irreversible material deformation produced in such cases dissipates kinetic energy. The result here is an axial displacement of the guide tube towards the body of the rail vehicle, i.e. in the longitudinal direction. In order to make possible a conversion of the collision energy which is as protective as possible, it is advantageous for the guide tube not to transfer any forces to the subframe or the cross members of the vehicle body. This is avoided by the cutout in the rail vehicle. The guide tube serves within the context of the invention as an additional ride-up protection, since radial movement in the vertical direction is prevented.

Expediently guide elements are provided for telescopic extension of the guide tube up to the cutout. In accordance with this advantageous development a clamping seat of the guide tube in the cross member or in the subframe of the rail vehicle is provided. This clamping seat provides further support for the ride-up protection of the inventive device.

In accordance with a preferred embodiment the impingement surface is equipped with ribs. The ribs can engage with the ribs of a colliding rail vehicle and then provide a ride-up protection.

The invention further relates to a rail vehicle with a device as claimed in one of the preceding claims. Expediently the rail vehicle has two of the said devices.

BRIEF DESCRIPTION OF THE SEVERAL VIEWS OF THE DRAWING

Further expedient embodiments and advantages of the invention are the subject matter of the description given below of exemplary embodiments of the invention, which refer to the figures of the drawing, wherein the same reference characters refer to components having the same effect and wherein.

DESCRIPTION OF THE INVENTION

Figure 1:
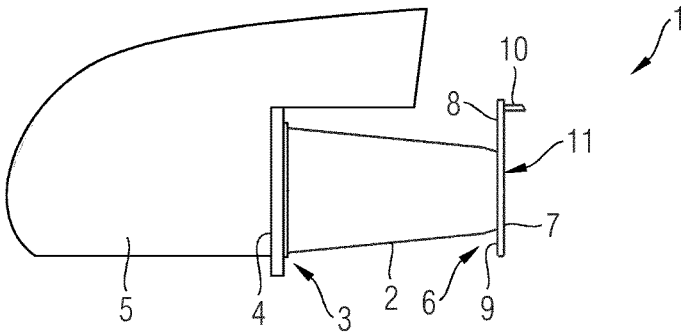
FIGS. 1 to 5 show exemplary embodiments of a side view of the inventive device in a position installed on the rail vehicle, FIG. 6 show the device according to FIG. 1 in a front view

FIG. 1 shows an exemplary embodiment of the inventive device 1 schematically in a side view. The inventive device 1 has an energy absorbing element 2 having a fastening side 3 with which it is fastened to a cross member 4 of a rail vehicle 5. The energy absorbing element 2 extends in a longitudinal direction which matches the direction of travel of the rail vehicle 5. At its end facing away from the fastening side 3 the energy absorbing element 2 forms an impact side 6 to which a flange 7 is fastened. The flange 7 protrudes beyond the outer contour of the energy absorbing element 2 on the impact side 6 while forming holding webs 8 and 9 which extend at right angles to the longitudinal direction, i.e. upwards or downwards respectively here. At the free end of the holding web 8 a vertical stop 10 can be seen, which protrudes from an impingement surface 11 of the flange 7. In the exemplary embodiment shown in FIG. 1 the vertical stop 10 is realized as a stop web which extends at right angles to the holding web 8.

Figure 2:
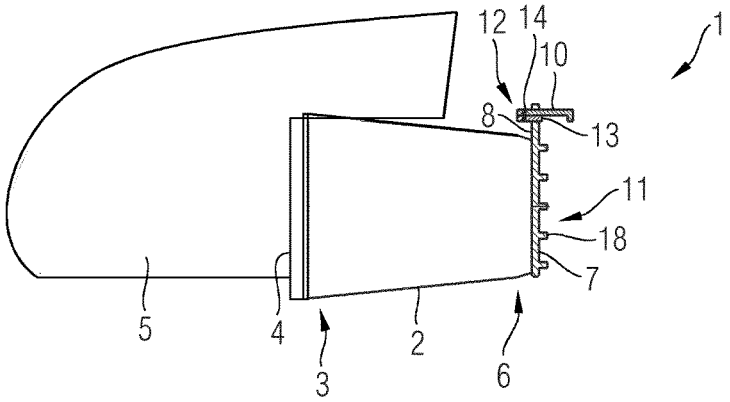

FIG. 2 shows a further exemplary embodiment of the inventive device 1, which differs from that shown in FIG. 1 merely in the embodiment of the flange 7. In accordance with FIG. 2 the flange 7 projects beyond the contour of the energy absorbing element at the impact side 6 only in a vertical direction, i.e. only upwards. FIG. 2 shows however that the vertical stop 10 is held with the aid of fastening means 12 on the holding web, wherein the fastening means 12 comprises a fastening plate 13 and also a rivet connection 14. Through the rivet connection 14 the vertical stop 10 is fastened to the fastening plate 13 welded to the flange. A sufficiently large impact stress in the longitudinal direction results in the fracture of the rivet connection 14 so that a displacement of the vertical stop 10 in the holding web 8 towards the fastening side 3 is made possible.

Figure 3:
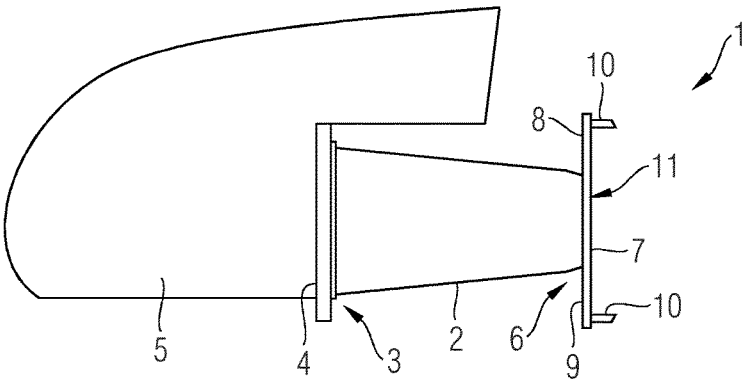

FIG. 3 shows a further exemplary embodiment of the inventive device which merely differs from the exemplary embodiment shown in FIG. 1 in that the lower holding web 9 is somewhat lengthened and is likewise equipped with a vertical stop 10.

Figure 4:
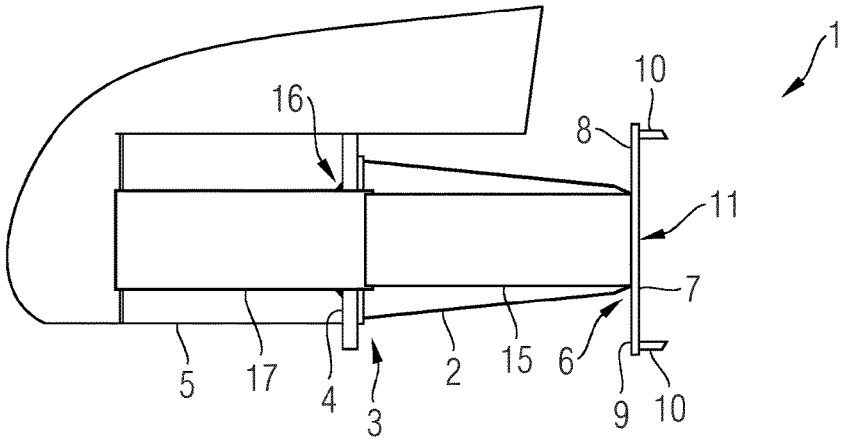

FIG. 4 shows a further exemplary embodiment of the inventive device which merely differs from the exemplary embodiment shown in FIG. 3 in that the device 1 has a guide tube 15 which extends out within the energy absorbing element 2 from the impact side 6 to the fastening side 3. A cutout 16 is provided in the cross member 4 of the rail vehicle 5. Disposed in the cutout 16 is a guide element 17 in the form of a holder tube. The holder tube 17 extends the guide tube 15 telescopically towards the cutout 16. The guide tube 15 disposed centrally in the energy absorbing element as well as the guide element 17 are connected to one another by a clamp seat. In a collision the guide tube 15 is pushed into the guide element 17. Because of the telescopic extension the result is axial guidance of the movement of the energy absorbing element 2, so that the ride-up protection 15 is improved.

Figure 5:
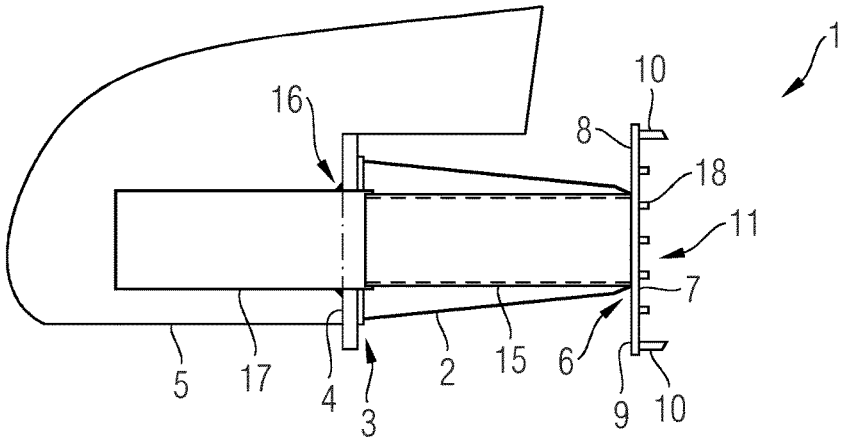

The exemplary embodiment shown in FIG. 5 corresponds to the exemplary embodiment shown in FIG. 4. However the holder plate 7 according to FIG. 5 is equipped with ribs 18 which, as already described, can take up vertical forces on engagement with other ribs in order in this way to prevent a ride-up of the colliding parties.

Figure 6:
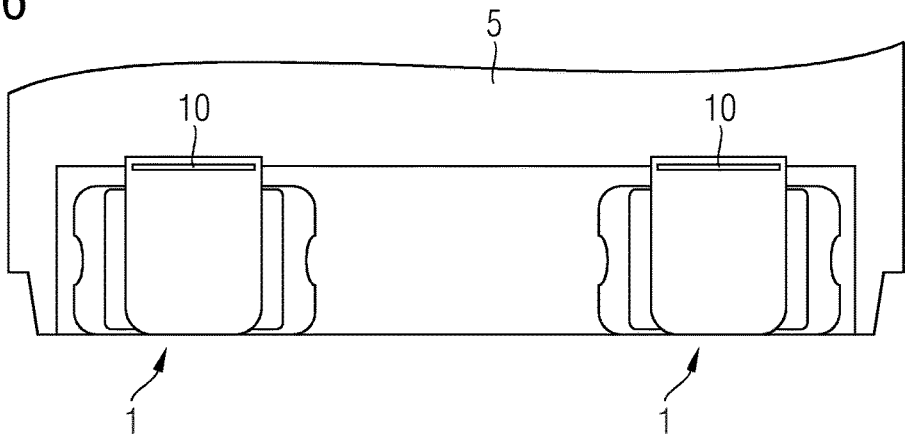

FIG. 6 shows the exemplary embodiment according to FIG. 1 in an end face view, wherein it can be seen that the rail vehicle is equipped with two devices 1 which are each disposed on the side of the rail vehicle 5. Thus the inventive device 1 serves as a side buffer.

Figure 7:
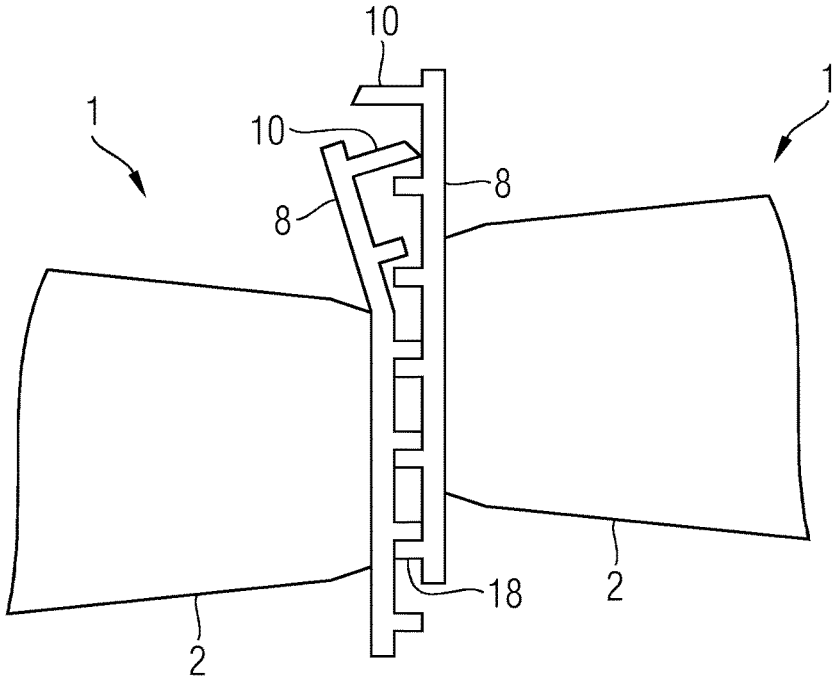
FIGS. 7 to 9 illustrate further embodiments of the invention during a collision.

FIG. 7 shows a further exemplary embodiment of the invention at the beginning of a collision. The exemplary embodiment of the inventive device 1 shown in FIG. 7 differs from the exemplary embodiment shown in FIG. 1 merely in that ribs 18 are embodied on the flange 7. FIG. 7 shows a collision with a rail vehicle which is equipped with a similar device 1. However a vertical offset between the energy absorbing elements 2 can be seen, in the sense that in FIG. 7 the device shown on the right is disposed somewhat higher than the device shown on the left. It can be seen that the holding web 8 of the left-hand device is dimensioned so that it has a thickness and length which makes it possible for the holding web 8 to bend towards the fastening side 3 of the energy absorbing element 2. Thus the ribs 18 of the two flanges 7 can effectively engage with one another before an irreversible deformation of the energy absorbing element 2 results, so that an effective ride-up protection is provided.

Figure 8:
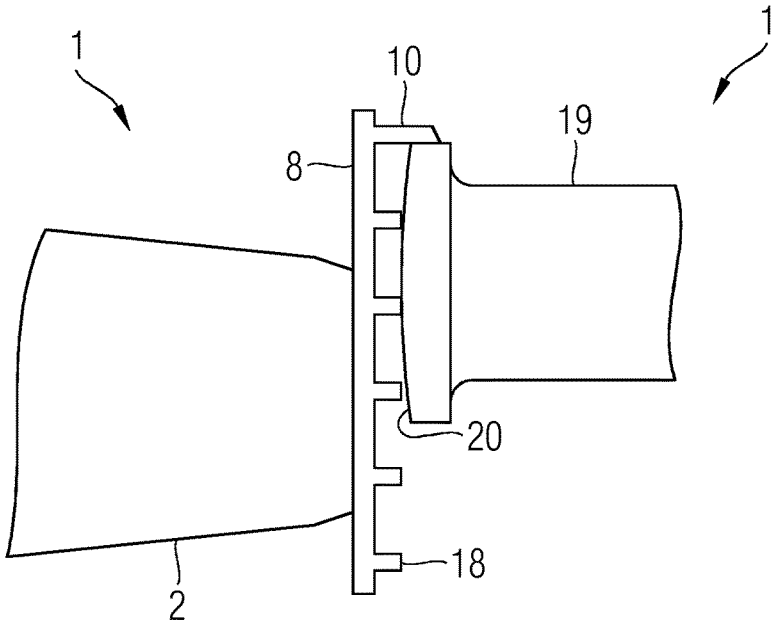

FIG. 8 shows the exemplary embodiment shown in FIG. 7 in the event of a collision with a buffer 19, which has a smooth surface 20. The smooth surface 20 does not have any ribs. Thus the ribs 18 of the inventive device 1 can also not provide any effective ride-up protection. However in this case, as is shown in FIG. 8, the vertical stop 10 prevents an undesired riding-up of the colliding party 19.

Figure 9:
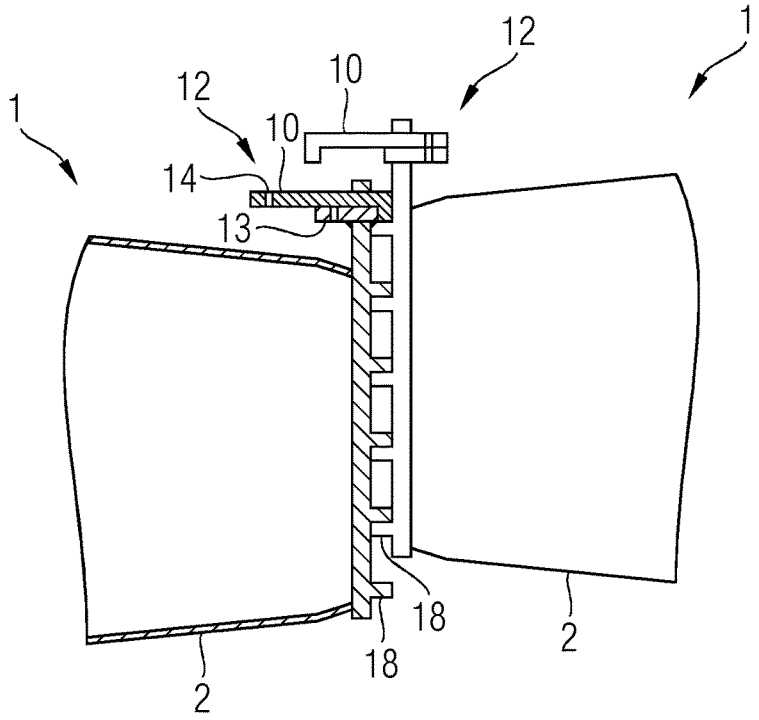

FIG. 9 shows the case of a collision between two devices in accordance with the exemplary embodiment shown in FIG. 2. It can be seen that the collision, i.e. the impact stress of the vertical stop 10 in the longitudinal direction, causes the rivet connection 14 to fracture. Thus a displacement of the vertical stop 10 in relation to the fastening plate 13, which is welded rigidly in the holding web 8, is made possible. The displacement makes it possible for the ribs 18 to engage with one another so that an effective ride-up protection within the framework of the invention is provided.

The invention claimed is:

1. A device for preventing rail vehicles from riding up, the device comprising:

an energy absorbing element extending in a longitudinal direction and having a hollow inside, a fastening side configured to be fastened to one of the rail vehicles, an impact side facing away from said fastening side and a contour delimited by said impact side;

a flange fastened to said impact side and having an impingement surface facing away from said fastening side, said flange projecting beyond said contour in at least one vertical direction to form a holder web projecting beyond said energy absorbing element and having a free end;

a vertical stop disposed at said free end of said holder web and projecting from said impingement surface; and a device for shifting said vertical stop in said longitudinal direction during an impact stress, said device for shifting said vertical stop including a fastening device for fastening said vertical stop to said holder web and permitting said vertical stop to shift in said holder web towards said fastening side in the event of the impact stress.

2. The device according to claim 1, wherein said device for shifting said vertical stop is formed by dimensioning said holder web to be bent in said longitudinal direction towards said fastening side in the event of the impact stress.

3. The device according to claim 1, wherein said impingement surface protrudes beyond said contour of said impact side of said energy absorbing element (2) in two vertical directions facing away from one another.

4. The device according to claim 1, wherein said energy absorbing element has a guide tube extending out within said energy absorbing element from said impact side to said fastening side.

5. The device according to claim 4, wherein said guide tube is configured to engage in a cutout provided in the rail vehicle.

6. The device according to claim 5, which further comprises guide elements for telescopically extending said guide tube through to the cutout.

7. A rail vehicle, comprising two of the devices according to claim 6.

8. A rail vehicle, comprising a device according to claim 1.

9. A device for preventing rail vehicles from riding up, the device comprising:

an energy absorbing element extending in a longitudinal direction and having a hollow inside, a fastening side configured to be fastened to one of the rail vehicles, an impact side facing away from said fastening side and a contour delimited by said impact side;

a flange fastened to said impact side and having an impingement surface facing away from said fastening side, said flange projecting beyond said contour in at least one vertical direction to form a holder web projecting beyond said energy absorbing element and having a free end;

a vertical stop disposed at said free end of said holder web and projecting from said impingement surface, said vertical stop being a stop web extending at right angles to said holder web; and a device for shifting said vertical stop in said longitudinal direction during an impact stress.

10. A device for preventing rail vehicles from riding up, the device comprising:

an energy absorbing element extending in a longitudinal direction and having a hollow inside, a fastening side configured to be fastened to one of the rail vehicles, an impact side facing away from said fastening side and a contour delimited by said impact side;

a flange fastened to said impact side and having an impingement surface facing away from said fastening side, said impingement surface having ribs, said flange projecting beyond said contour in at least one vertical direction to form a holder web projecting beyond said energy absorbing element and having a free end;

a vertical stop disposed at said free end of said holder web and projecting from said impingement surface; and a device for shifting said vertical stop in said longitudinal direction during an impact stress.

* * * * *